United States Patent [19]

Knibbs

[11] 4,218,844

[45] Aug. 26, 1980

[54] MODEL FIGURES

[76] Inventor: Robin K. Knibbs, 143, London Rd., Brighton, East Sussex, England, BN1 4JH

[21] Appl. No.: 5,834

[22] Filed: Jan. 23, 1979

[30] Foreign Application Priority Data

Jan. 26, 1978 [GB] United Kingdom ..... 31204/78

[51] Int. Cl.[2] ..... A63H 11/14

[52] U.S. Cl. ..... 46/149; 46/22

[58] Field of Search ..... 46/149, 154, 151, 161, 46/115, 22

[56] References Cited

U.S. PATENT DOCUMENTS

| | | | |
|---|---|---|---|
| 1,762,574 | 6/1930 | Fox | 46/149 |
| 2,108,345 | 2/1938 | Orloff | 46/149 X |
| 2,111,348 | 3/1938 | Wheater | 46/149 |

FOREIGN PATENT DOCUMENTS

| | | | |
|---|---|---|---|
| 924615 | 4/1947 | France | 46/149 |
| 957951 | 3/1950 | France | 46/149 |

*Primary Examiner*—Louis G. Mancene

*Assistant Examiner*—Mickey Yu

*Attorney, Agent, or Firm*—Browdy and Neimark

[57] ABSTRACT

A model figure of an animal which can be caused to perform a forward walking movement or like forward travelling motion by the application of finger or other manual pressure to the head of the model animal. The model basically comprises a first member (1) which includes an upper jaw and two fore limbs, and a second member (12) which includes a lower jaw, a body and at least one hind limb, the two members being pivotally interconnected by a pin (10) or the like which is situated at, or substantially at, the junction between the upper and lower jaws. The limbs have a good frictional engagement with any supporting surface and an operator of the model first tilts the first member (1) so that its limbs slide forwardly over said surface and subsequently rocks that member (1) forwardly about the points of engagement of said limbs with the supporting surface so that the or each limb of the second member (12) slides forwardly over the surface, the jaws being repeatedly opened and closed during continued forward progress.

8 Claims, 3 Drawing Figures

MODEL FIGURES

BACKGROUND OF THE INVENTION

This invention relates to model figures of animals but it is emphasised that the word "animal(s)" is to be interpreted in this specification as including human beings, sub-humans, extinct animals, "space" figures and, in particular, any grotesque caricature or distortion of any species of animal.

Several forms of model animal figure have been proposed which children and others can cause to simulate the travelling motion or the animals concerned but these known figures have not proved to be very popular commercially because they are either very unrealistic in their travelling action or are excessively complicated in construction making them initially expensive and subsequently somewhat liable to breakage or malfunction, particularly when subject to rough usage by children of pre-school age.

SUMMARY OF THE INVENTION

The present invention seeks to provide strong but simple and therefore inexpensive model figures of animals whose constructions are such that children and others can apply manual forces to them to cause them to perform travelling motions over surfaces in manners which, whilst not being complicated, are at least sufficiently realistic to satisfy young children.

Such model figures of animals are intended to overcome, or at least very markedly to reduce, the shortcomings of the known "travelling motion" figures which have been briefly discussed above and accordingly the invention provides a model figure of an animal comprising a first member having a visual resemblance to the fore limbs and a part of the head including the upper jaw of the animal, and a second member pivotally connected to the first member and having a visual resemblance to at least one hind limb, the body and a part of the head including the lower jaw of the animal, wherein the pivotal connection between said first and second members is at substantially the junction between the upper and lower jaws of the animals.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE PREFERRED EMBODIMENTS

Figure 1:
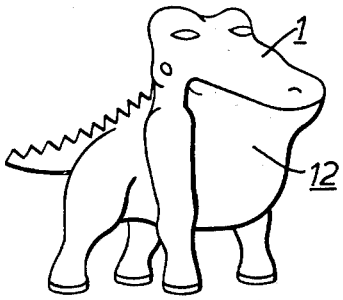
FIG. 1 is a perspective view of a fully assembled model figure of an animal in accordance with the invention in the form of a caricature of a pre-historic animal.
Figure 2:
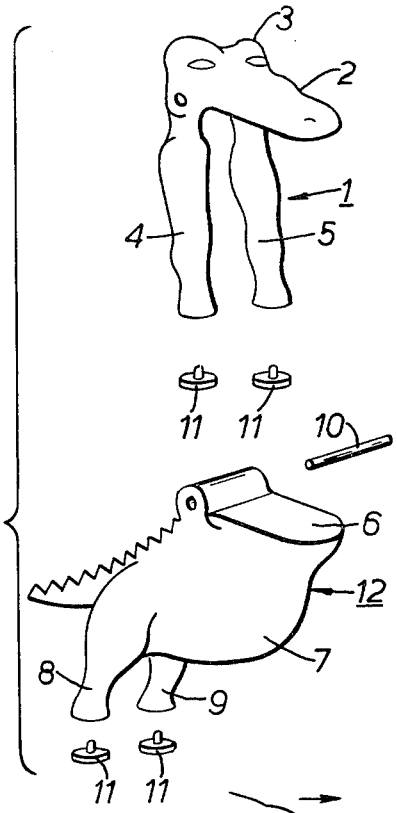
FIG. 2 is an exploded perspective view illustrating the component parts of the embodiment of FIG. 1.

Referring to the accompanying drawings, and particularly to FIGS. 1 and 2 thereof, the model that is illustrated in those Figures is a caricature of a pre-historic animal, FIG. 2 showing the component parts thereof. It will be seen from FIG. 2 that the model animal is afforded principally by a first member 1 and a second member 12. The first member 1 includes, and therefore has a visual resemblance to, a part of the head 3 of the animal which part includes an upper jaw 2 and two opposed fore limbs of the animal in the form of legs 4 and 5. The second member 12 consists of, and consequentially has a visual resemblance to, a part of the head of the animal in the form of its lower jaw 6, its body 7 and two opposed hind limbs in the form of legs 8 and 9. The two members 1 and 12 of the model animal figure are preferably, but by no means essentially, each formed in two substantially symmetric halves from a synthetic plastics material such as acrylonitrile butadiene styrene, and from a separate pivot pin 10, which will usually be steel or other metal, which pivotally interconnects the two members 1 and 12, it being noted that the second member 12 is supported on the first member 1 in the form of a pendulum and that it is preferred that the centre of gravity of the second member 12 should be so located with respect to the axis which is embodied in the pivot pin 10 that the assembled model tends to adopt the attitude or configuration which is shown in FIG. 1 of the drawings if it is lifted clear of a supporting surface solely by means of its first member 1. Instead of the pivotal connection between the two members 1 and 12 being a separate entity such as the pivot pin 10, it is within the scope of the invention for at least one spigot that is intended to define the pivotal connection between the members 1 and 12 to be formed integrally with at least one of the initial halves of one of those members 1 or 12. The pivot pin 10 or equivalent spigot preferably has a minimum diameter of one eighth of an inch (3.2 millimeters) and, in the case of a metal pivot pin 10, washers (not shown) are preferably provided around that pin at the two junctions between the members 1 and 12.

As will become apparent below in a discussion of the travelling motion of a model animal figure in accordance with the invention, it is most desirable that there should be a good frictional grip between the limbs of the model animal and any more or less flat surface over which it is caused to travel. To this end, the lower extremities of all four of the legs 4, 5, 8 and 9 are provided with rubber foot pads 11. It will be realised that elastomeric materials other than natural rubber could equally well be employed to make the pads 11 and that pads of the kind which are shown in the drawings, which pads include upwardly projecting central dowels arranged to cooperate with matching recesses at the lower ends of the respective legs, could equally well be replaced with pads of rubber or other elastomeric material that are fixed to the corresponding legs by an adhesive. It is also possible to form the members 1 and 12 from a material having a high coefficient of friction in which case the lower ends of the legs 4, 5, 8 and 9 will already have sufficient frictional grip upon co-operating surfaces without the provision of the foot pads 11 or any equivalent elements. A further alternative is to dip the "foot" ends of the legs 4, 5, 8 and 9 in a solution, or a liquefied mass, of a suitable elastomer. The two initially separate and substantially symmetric halves of each of the two members 1 and 12 are secured to one another, during assembly, by solvent adhesive welding, by ultrasonic welding, by glue, or by an appropriate combination of these techniques.

Figure 3:
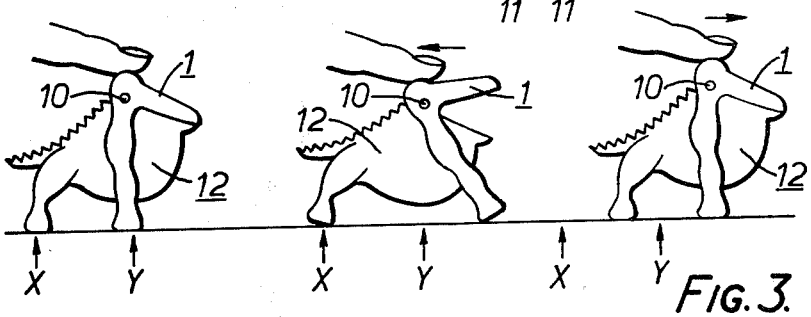
FIG. 3 is a diagrammatic side elevation illustrating the way in which the model pre-historic animal of FIGS. 1 and 2 can be caused manually to perform a forward travelling motion over a surface.

FIG. 3 of the drawings diagrammatically illustrates the manner in which the model figure of an animal of FIGS. 1 and 2 is caused to simulate forward motion over a more or less flat surface by the manual pressure of a finger on the head 3 of the animal. The left-hand part of FIG. 3 shows the model animal at rest in the attitude or configuration of FIG. 1 of the drawings with its fore legs 4 and 5 on the co-operating more or less flat surface at points Y and with its rear legs on the same surface at two points X. The centre part of FIG. 3 shows the first step in causing the model animal to simulate forward motion (in this case, walking). During this step, the finger of the operator exerts a rearward pressure (i.e., from right to left as seen in FIG. 3) on the head 3 of the model animal and this causes the member 1 to pivot pendularly about the pin 10 in an anti-clockwise direction, as seen in FIG. 3, the two front legs 4 and 5 thus sliding forwardly to the right away from the points Y whilst the two rear legs 8 and 9 remain in contact with the two points X by virtue of the good frictional grip between their rubber foot pads 11 and the co-operating more or less flat surface. At the same time as the front legs 4 and 5 move forwardly to the right as seen in FIG. 3, the jaws 2 and 6 of the model animal are opened. The right-hand part of FIG. 3 shows the second step in simulating the forward motion of the model animal and it will be seen that, in this second step, the finger of the operator applies pressure to the head 3 in a direction which is reversed as compared with the second part of FIG. 3 and which is thus from left to right as seen in that Figure. The rubber foot pads 11 or the like of the front legs 4 and 5 make a good frictional engagement with the co-operating support surface and the whole first member 1 of the model animal accordingly pivots forwardly about those points of contact in a clockwise direction as seen in FIG. 3. Due to the position of the centre of gravity of the second member 12 which has been discussed above, said second member 12 pivots pendularly about the pin 10 relative to the first member 1 as said pin 10 is displaced to the right in FIG. 3, the pads 11 or other elements at the lower ends of the rear legs 8 and 9 being caused to slide to the right over the supporting surface. The jaws 2 and 6 close during this second step and it will be noted that, at the completion of this second step, the model animal again occupies the attitude or configuration of FIG. 1 and the first part of FIG. 3 of the drawings but that it has been displaced some distance to the right with respect to the points X and Y. If, as will usually be the case, further forward progress of the model animal is required, the first and second steps that have been described above with reference to FIG. 3 of the drawings are repeated as many times as may be required and it has been found that even quite young pre-school age children can quickly learn this simple procedure and that the form of forward motion which results is sufficiently realistic to satisfy them.

Figure 4:
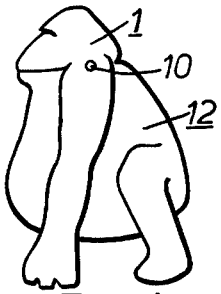
FIGS. 4, 5 and 6 are side elevations illustrating, purely by way of example, other forms of model figures of animals that may be provided in accordance with the present invention.
Figure 5:
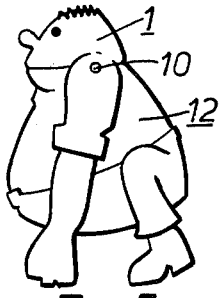
Figure 6:
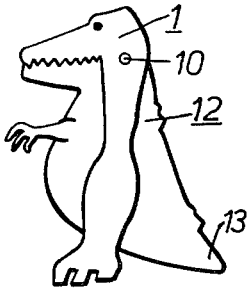

FIG. 4 is an illustration of a model of an ape-like creature which uses its arms for walking or running travelling motion in the same manner as a four-legged animal uses its front legs. Similarly, the grotesque human, or sub-human model which is shown in FIG. 5 also uses its arms in the manner of front legs. FIG. 6 shows a model of a caricature of a pre-historic animal in which the fore limbs of the first member 1 are a pair of legs whilst the second member 12 has only a single rear limb which is in the form of a tail 13. It will be apparent that forward travelling motion of the model animal figure of FIG. 6 is accomplished in substantially exactly the same way as has already been described above with reference to FIG. 3, the only difference being that the tail 13 contacts a more or less flat supporting surface at a single point rather than at two points. The tail 13 may incorporate an elastomeric pad equivalent to one of the foot pads 11 to increase the frictional grip thereof, may have an elastomeric pad secured to it by adhesive, may be formed from a material which already has a high coefficient of friction, or may be dipped in molten elastomer or elastomer solution as mentioned above. The model animal of FIG. 6 has only rudimentary arms 14 which do not take any part in the forward travelling motion of the model animal. This is accomplished by repeatedly extending and contracting the distance between the legs of the first member 1 and the tail 13 of the second member 12.

It will be apparent from the foregoing description that the term "hind limbs" is used to include both the hind legs of a four-legged animal and the legs of a two-legged animal. In addition, in the case of two-legged animals which walk with the aid of a tail, the term "fore limbs" refers to the legs of the animal, while the term "at least one hind limb" refers to the tail. The top of the head 3 of a model animal in accordance with the invention may advantageously, but by no means essentially, be formed with serrations or other roughening to minimise slippage between the head 3 and the finger of an operator. It is noted that, in some embodiments, skillful manual pressure on the head 3 of the model animal can be exerted to cause the model animal to walk or otherwise travel in a rearward direction. If desired, a sound-producing mechanism (not shown) may be connected between the two members 1 and 12 so that the model animal makes a sound each time it opens its jaws 2 and 6. Such a mechanism could be arranged to produce a "jaw snapping" sound in the case of a model animal such as the animal of FIGS. 1 to 3 or FIG. 6 or, for example, a bird call in the case of a model animal in the form of a bird and having jaws in the form of a beak or bill. In addition to the embodiments which are illustrated in the drawings and to the "bird" embodiment which has just been mentioned, model animals in accordance with the invention may be produced in the form of dogs, elephants, frogs, lions, human beings and many other appearances which more or less accurately represent real animals or which are imaginary animals, space figures, mythological figures, combinations of two animals (i.e., a rider mounted on a horse), fantasy figures, grotesque figures and distortions of the appearance of real or already known fantasy figures. In every case, the pivotal connection 10 between the first and second members 1 and 12 is at, or substantially at, the junction between the upper and lower jaws 2 and 6 of the model animal except that, in the case of a model animal figure which is a combination of two animals, said pivotal connection will be at, or substantially at, the junction between the upper and lower jaws of one of them.

I claim:

1. A model figure of an animal comprising a first member having a visual resemblance to the fore limbs and a part of the head including the upper jaw of the animal, and a second member pivotally connected to the first member and having a visual resemblance to at least one hind limb, the body and a part of the head including the lower jaw of the animal, wherein the pivotal connection between said first and second members is at substantially the junction between the upper and lower jaws of the animal.

2. A model according to claim 1, wherein the centre of gravity of said second member is so positioned that, when the model is lifted clear of a supporting surface by the first member alone, the model adopts an attitude/-configuration in which said upper and lower jaws are closed.

3. A model according to claim 1, wherein the pivotal connection between said first and second members is in the form of an initially separate pin.

4. A model according to claim 1, wherein said fore limbs and at least one hind limb are provided with elastomeric elements designed to increase the frictional grip of said limbs upon a supporting surface.

5. A model according to claim 1, wherein said at least one hind limb of said second member is a part of that second member which has a visual resemblance to an animal tail.

6. A model according to claim 1, wherein said at least one hind limb of the second member bears a visual resemblance to the two legs of a two-legged animal.

7. A model according to claim 1, wherein said part of the head which includes the upper jaw of the animal is provided, on that part, with roughening to minimise slippage between the finger of an operator and said part of the head.

8. A model according to claim 2, wherein the second member is pivotally connected to the first member in the manner of a pendulum.

* * * * *